US005251532A

United States Patent [19]

Frommelt et al.

[11] Patent Number: 5,251,532

[45] Date of Patent: Oct. 12, 1993

[54] CARTRIDGE CLIP FOR SETTING TOOL

[75] Inventors: Markus Frommelt, Schaan, Liechtenstein; Uwe Hilmert, Sevelen, Switzerland

[73] Assignee: Hilti Aktiengesellschaft, Fürstentum, Liechtenstein

[21] Appl. No.: 972,672

[22] Filed: Nov. 6, 1992

[30] Foreign Application Priority Data

Nov. 11, 1991 [DE] Fed. Rep. of Germany ..... 4136932

[51] Int. Cl.[5] ..... B25C 1/16

[52] U.S. Cl. ..... 89/1.14; 227/10

[58] Field of Search ..... 89/1.14; 227/9, 10, 227/11

[56] References Cited

U.S. PATENT DOCUMENTS

| | | | |
|---|---|---|---|
| 3,552,625 | 1/1971 | Udert | 227/10 |
| 3,565,313 | 2/1971 | Seghezzi et al. | 227/10 |
| 3,679,118 | 7/1972 | Maier et al. | 227/10 |
| 3,981,424 | 9/1976 | Maier | 227/10 |
| 4,201,324 | 5/1980 | Maier et al. | 227/9 |
| 4,368,588 | 1/1983 | Jochum et al. | 42/49.01 |
| 4,406,079 | 9/1983 | Buechel et al. | 89/35.01 |

FOREIGN PATENT DOCUMENTS

| | | | |
|---|---|---|---|
| 2101499 | 7/1972 | Fed. Rep. of Germany | 227/10 |

*Primary Examiner*—David H. Brown

*Attorney, Agent, or Firm*—Anderson Kill Olick & Oshinsky

[57] ABSTRACT

An explosive powder charge operated setting tool has a guide channel (9) for strip-shaped cartridge clips with feed members (10) and a restraining member (15) extending into the transverse cross-section of a guide channel (9) for the cartridge clips. Blocking parts (13, 14) are located at the insertion end region of the guide channel (9). The blocking parts (10, 11) are displaced outwardly from one another out of the guide channel (9) by insertion bevels (8*c*, 8*d*) on the end of the cartridge inserted first into the guide channel, so that the cartridge clip (8) can be pushed further into the guide channel (9) until it reaches the feed member (10) or the restraining member (15).

8 Claims, 3 Drawing Sheets

CARTRIDGE CLIP FOR SETTING TOOL

BACKGROUND OF THE INVENTION

The present invention is directed to an explosive powder charge operated setting tool and a strip-shaped cartridge clip where the setting tool has a guide channel for the cartridge clip extending generally perpendicularly to the setting direction of the tool. The guide channel contains feed means and restraining means for engagement with the cartridge clip and which cooperate with recesses in long edges of the cartridge clip.

An explosive powder charge operated setting tool with a feed arrangement for a strip-shaped cartridge clip is disclosed in DE PS 17 28 198. The feed or restraining means for conveying the cartridge clip is disposed in the vicinity of a firing device. A new cartridge clip must be introduced into the guide channel up to the region of the firing device to assure that it is secured from dropping out of the feed or restraining means. Accordingly, the setting tool is ready to function in this position of the cartridge clip, however, it presents safety problems.

The firing device in the housing of the setting tool includes a firing pin, whereby single cartridges can be fired. Rim primed cartridges in this cartridge clip can be ignited by the firing pin which strikes the cartridge at its base somewhere in its circumferential region.

Since the ends of the cartridge strip bounding its length are configured identically, either end of the cartridge clips can be inserted into the guide channel. As a result, it must be assured when rim primed cartridges are used, that the asymmetrically arranged firing pin of the firing device reaches the detonator charge. Accordingly, a circumferentially disposed detonator charge is required and a relatively great amount of the detonator charge is needed.

A detonator charge involving less material and disposed for economic and safety reasons at a specific point at the circumference of the base of the cartridge cannot be used, because there is the problem of an incorrectly inserted cartridge clip where the firing pin will not strike the detonator charge.

SUMMARY OF THE INVENTION

Therefore, it is the primary object of the present invention to provide the combination of a setting tool and a cartridge clip where the cartridges can be placed in a specific position by the cartridge clip and the cartridge clip is prevented from falling out of the tool prior to reaching an operating or firing position.

In accordance with the present invention, blocking parts displaceable against a spring force are located on opposite long sides of the guide channel corresponding to the long sides or edges of the cartridge clip and the blocking parts project into the transverse cross-section of the guide channel in its inlet region upstream of the feed means and restraining means. The length of the blocking parts in the long direction of the guide channel is greater than the length of the recesses in the cartridge clip and the cartridge clip has control cams at an end inserted first into the guide channel which displace the blocking parts laterally outwardly.

The blocking parts arranged in this manner project into the transverse cross-section of the guide channel to such an extent that a wrong insertion of the cartridge clip into the channel is not possible. If the correct end of the cartridge clip is inserted into the guide channel, the blocking parts are displaced outwardly by the control cams on the cartridge clip, whereby the cartridge clip can continue inward movement into the guide channel.

Preferably, the blocking parts are flexural wall portions of the guide channel. Such blocking parts are easy to fabricate, save space, and can be manufactured economically. When forming the walls of the guide channel, care must be taken that the material forming the blocking parts has a modulus of elasticity suitable to afford the flexural character of the blocking parts in accordance with the present invention. The spring forces for retaining the cartridge clip are supplied by the outwardly displaced blocking parts.

The blocking parts include blocking lugs and restraining cams in an expedient arrangement, with the blocking lugs located upstream of the restraining cams in the direction of movement of the cartridge clip through the guide channel. The blocking lugs project into the transverse cross-section of the guide channel for preventing any improper insertion of the cartridge clip. The blocking lugs form a stop surface, preferably extending perpendicularly of the direction of movement of the cartridge clip through the guide channel.

The spacing between the blocking lugs and the restraining cams is selected so that the blocking lugs cannot reach into the recesses disposed along the long edges of the cartridge clip.

Depending on the particular use of the setting tool, there are cartridge clips with propellant charges of different strengths. If a cartridge clip with a wrong propellant charge energy is placed into the guide channel, the cartridge clip can be pulled out of the channel opposite to the feed direction, as long as the recesses along the long edges of the cartridge clip do not engage the feed means and restraining means.

Preferably, the restraining cams have a contour which is essentially circular segment-like. If the contour of the restraining cams forms a portion of a circle, then the radius of the circle is in the range of 0.6 to 1.3 times the length of a recess in the cartridge clip. The restraining cams having a circular segment-like shape are located in the mouth region of the recesses at the long edges of the cartridge clip, so that the restraining cams do not extend into contact with the base of the recesses. With the restraining cams formed with an essentially circular segment-like shape, a good engagement and disengagement of the blocking parts is assured.

The dimension between the restraining cams located opposite one another and adjoining the long edges of the cartridge clip is expediently smaller than the blocking lugs located opposite one another. Due to the greater spacing of the blocking lugs, the approach of the restraining cams into the mouth region of the recesses in the cartridge clips is possible only when the restraining cams engage the mouth region of the recesses, with the blocking lugs located outwardly from the long edges of the cartridge clip.

In a preferred arrangement, the control cams are formed as insertion bevels along the long edges at the end of the clip inserted first into the guide channel. Such insertion bevels can be manufactured simply and economically and assure a uniform or linear outward displacement of the blocking parts. Due to the insertion bevels, the end of the cartridge clip inserted into the guide channel tapers inwardly. The smallest tapered width of the cartridge clip is less than the spacing between the blocking lugs or the restraining cams, when they project into-the transverse cross-section of the guide channel.

By arranging the insertion bevels offset in the long direction relative to one another, the blocking parts can be shifted one after the other out of the cross-section of the guide channel. Such an arrangement is particularly advantageous if the spring forces of the blocking parts acting counter to the outward displacement are relatively large, whereby a simultaneous displacement of both blocking parts requires an excessive effort.

In a preferred arrangement, the insertion bevels extend symmetrically to one another along both long edges. As a result, the blocking parts are pressed out of the cross-section of the guide channels at the same time.

The insertion bevels are expediently disposed on an extended length of the cartridge clip. Such extended length of the cartridge clip has an advantageous effect on the removal of the clip out of the guidance channel. The overall length of the cartridge clip is grater than the length of the guide channel so that the inserted clip projects out of the insertion end and/or exit end of the channel. Accordingly, it is possible to remove the cartridge clip at any time. The length of the guide channel can correspond to the length of the setting tool measured parallel to the channel.

When the cartridge clip projects outwardly from the insertion end of the guide channel, it can be pushed into the channel until it projects out of the exit end of the channel. In this position, the cartridge clip can be gripped in the extended length region containing the insertion bevels and can be pulled out of the guide channel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
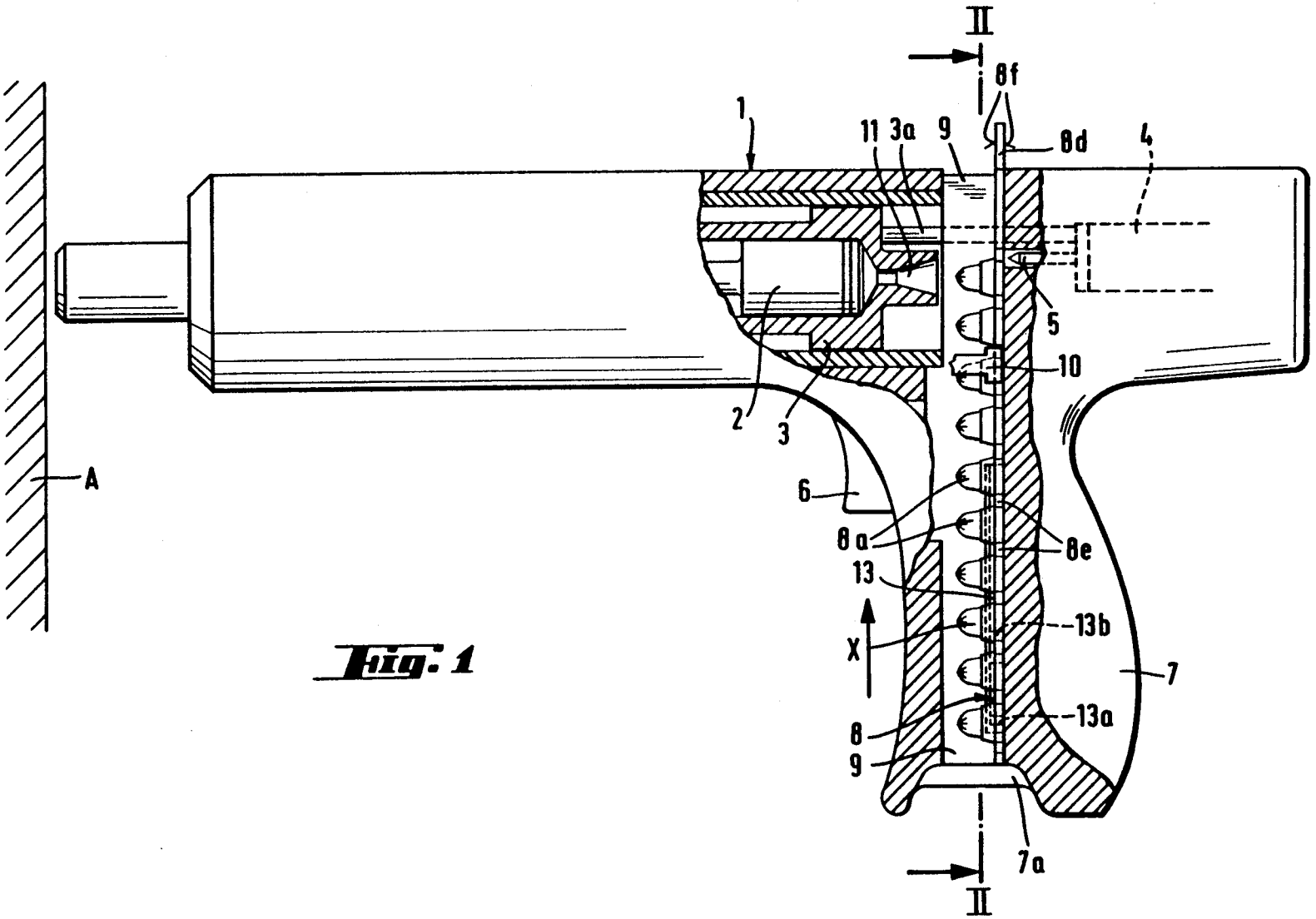
FIG. 1 is a side view of a setting tool embodying the present invention, shown partly in section, and containing a guide channel with a cartridge clip inserted in the channel.

An explosive powder charge operated setting tool is illustrated in FIG. 1 and includes a housing 1, a driving piston 2, a guide cylinder 3 for the driving piston, a safety pin 3*a*, a firing device 4 with a firing pin 5, a trigger for initiating operation of the firing device 4, and a handle 7 extending downwardly from the housing 1 and arranged generally perpendicularly to the firing direction of the tool, that is, the direction of the housing extending perpendicularly to the member A to which a fastening element or the like can be driven by the tool. A guide channel 9 for guiding a cartridge clip 8, containing separate spaced cartridges 8*a*, extends upwardly through the handle 7 and the housing 1.

The entrance or insertion end of the guide channel 9 is located in the lower end of the handle 7 and the feed direction is represented by an arrow X. In the region of the housing 1, feed means 10 is located in the transverse cross-section of the guide channel 9 for conveying the cartridge clip into position for firing a cartridge. The cartridge clip is held in position by restraining means 15, note FIGS. 2–5.

Individual cartridges 8*a* are ignited by a firing pin 5 of the firing device 4. The operation of the firing device is initiated by the trigger 6. A safety pin 3*a* is located at the trailing end of the guide cylinder 3 and extends rearwardly from it opposite to the driving or setting direction. The safety pin 3 is displaced opposite to the setting direction when the setting tool is pressed against the member A and releases the firing mechanism so that it can be operated.

Figure 2:
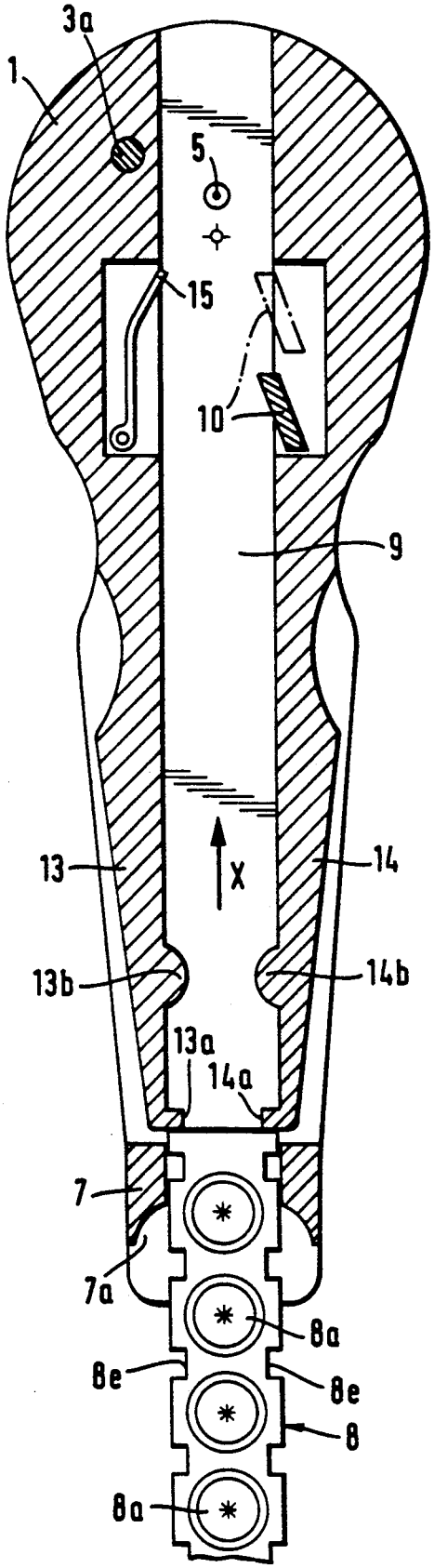
FIG. 2 is a cross-sectional view on an enlarged scale, taken along the line II—II in FIG. 1 with an improper end of the cartridge clip inserted into the guide channel.
Figure 3:
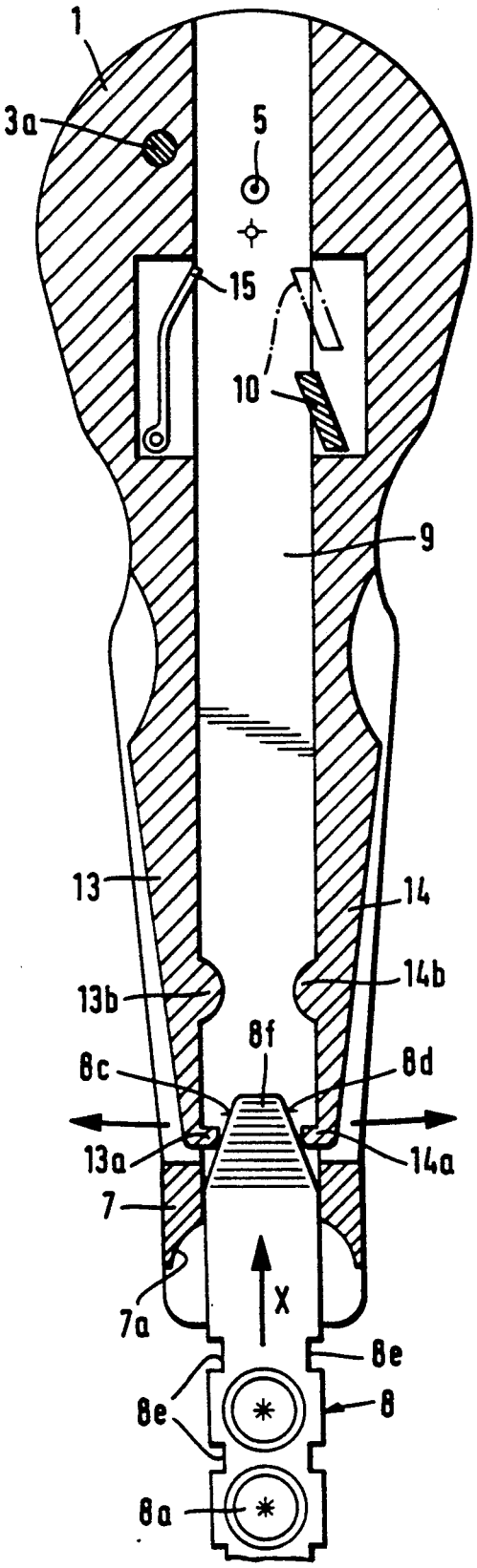
FIG. 3 is a cross-sectional view, similar to FIG. 2, with an end of the cartridge clip correctly inserted into the guide channel.
Figure 4:
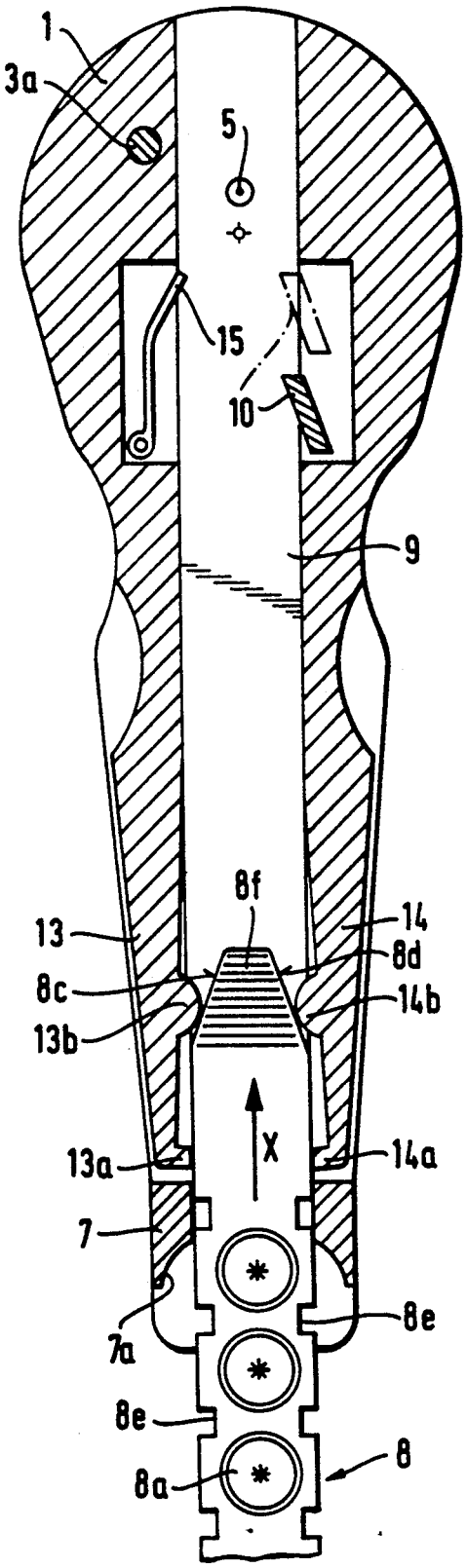
FIG. 4 is a cross-sectional view similar to FIG. 3 with the cartridge clip inserted further into the guide channel than that shown in FIG. 3.
Figure 5:
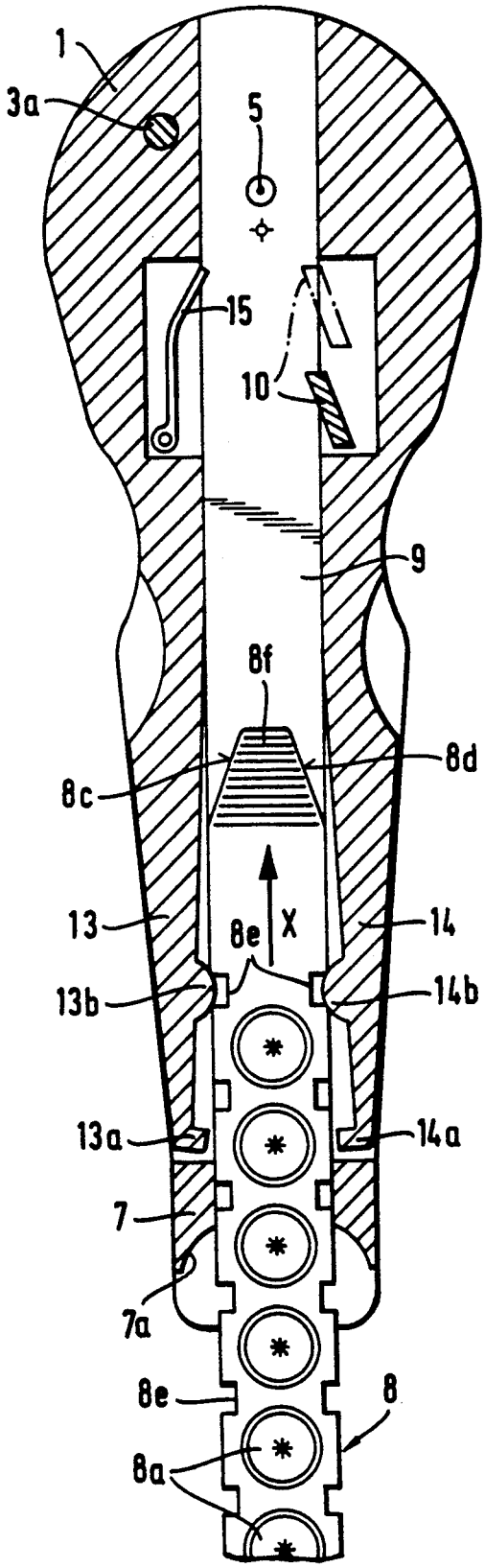
FIG. 5 is a cross-sectional view, similar to that shown in FIGS. 3 and 4, with the cartridge clip inserted still further into the guide channel.

In FIGS. 3, 4 and 5, individual steps in the insertion of the cartridge clip 8 into the guide channel 9 are shown, while FIG. 2 shows blocking parts 13, 14 projecting into the transverse cross-section of the guide channel 9 preventing the insertion of a cartridge clip 8 when a wrong end is inserted, note the end of the cartridge clip blocked from entry into the guide channel by the inwardly projecting blocking lugs 13*a*, 14*a*.

Blocking parts 13, 14 extend in the long direction of the guide channel 9 and form flexurally acting wall portions of the guide channel 9. Because of their flexural characteristic, care must be taken when selecting material for such wall portions whereby their modulus of elasticity meets the necessary flexural characteristics. The blocking parts 13, 14 can be appropriately shaped, whereby excessive force is not needed to displace the blocking parts 13, 14 laterally outwardly from the transverse cross-section of the guide channel 9.

The proper front end of the cartridge clip is shown in FIG. 3 and includes insertion bevels 8*c*, 8*d* arranged symmetrically on opposite sides of the cartridge clip and acting as control cams. The insertion bevels are formed by the long edges of the cartridge clip 8. When the correct end of the cartridge clip 8 is inserted into the guide channel 9, initially the blocking lugs 13*a*, 14*a* are contacted by the bevels 8*c*, 8*d* and subsequently the bevels contact the restraining cams 13*b*, 14*b* as shown in FIG. 4. Upon further insertion of the cartridge clip 8 into the guide channel 9, the blocking parts 13, 14 are displaced laterally out of the transverse cross-section of the guide channel 9 until the dimension between the restraining cams 13*b*, 14*b* corresponds to the width or transverse dimension of the cartridge clip 8.

If the cartridge clip 8 is moved in the direction X, the restraining cams 13*b*, 14*b* arrive in the mouth region of two oppositely disposed recesses 8*e*, note FIG. 5. The restraining cams 13*b*, 14*b* have a circular arc shape with the radius of the circular arc in the range of 0.6 to 1.3 times the length of the recesses 8*e* in the cartridge clip.

The radius of the circular arc is selected so that a good engagement or disengagement of the restraining cams 13*b*, 14*b* is assured as the insertion of the cartridge clip into the guide channel 9 is continued manually or by the feed means 10.

If the spacing of the blocking parts 13, 14 from one another is noted, where they rest or contact the long edges of the cartridge clip 8, the spacing between the blocking lugs 13*a*, 14*a* is larger than the spacing between the restraining cams 13*b*, 14*b*, note FIG. 5. Preferably, the blocking parts 13, 14 are located in the insertion region of the guide channel 9, whereby an appropriate spacing is afforded between the blocking parts and the feed means 10 or the restraining means 15. As a result, a cartridge clip 8 can be pushed into the guide channel 9 until the restraining cams 13*b*, 14*b* seat into the recesses 8*e* closest to the insertion bevels 8*c*, 8*d*. In this position, the setting tool is not yet ready for operation. The cartridge clip 8, however, is secured against dropping out of the tool in this position.

As can be seen in FIG. 1, the length of the cartridge clip 8 is greater than the length of the guide channel 9. In the inserted condition, the cartridge clip projects from the entrance end or the exit end of the guide channel 9.

The dimension of the setting tool extending parallel to the guide channel 9 exceeds the length of the guide channel. The insertion end of the guide channel is accessible through a basin-like depression 7*a* in the bottom of the handle 7. The size of the depression 7*a* corresponds approximately to the size of a thumb, whereby the portion of the cartridge clip 8 extending out of the entrance end can be pushed into the guide channel, until the cartridge clip projects from the exit end.

With the extended length of the cartridge clip 8 projecting out of the exit end of the guide channel, the profiling 8*f* on the front end of the clip permits an improved grip on the cartridge clip.

While the invention has been illustrated and described as embodied in a cartridge clip for a setting tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

We claim:

1. An explosive powder charge operated setting tool including a strip-shaped cartridge clip (8) having a first end and a second end with a pair of long sides extending in the direction between the first end and the second end and recesses spaced apart in each of the long sides, said setting tool comprising a housing (1) extending in the setting direction and a handle (7) located at a rear end of the tool and extending transversely of the setting direction, said handle (7) and housing (1) forming a guide channel (9) extending generally perpendicularly to the setting direction, feed means (10) and restraining means (15) located within the guide channel for engaging said recesses (8*e*) in the cartridge clip (8), wherein the improvement comprises blocking parts (13, 14) extending in the direction of and located on opposite sides of the guidance channel, so that the blocking parts extend along the long sides of the cartridge clip, said blocking parts are flexurally biased towards one another by spring force and are displaceable away from one another by overcoming the spring force, said guide channel has an insertion end for inserting said cartridge clip (8) and an outlet end for removing said cartridge clip, said blocking parts project into said guide channel adjacent the insertion end thereof when the channel is free of said cartridge clip and are located upstream from said feed means (10) and restraining means (15), said blocking parts have a length in the insertion end-outlet end direction of said guide channel greater than the length in the same direction of one recess (8*e*), and said cartridge clip has control cams at the first end thereof inserted first into the insertion end of said guide channel for displacement of said blocking parts laterally outwardly away from one another.

2. An explosive powder charge operated setting tool, as set forth in claim 1, wherein said control cams comprise insertion bevels (8*c*, 8*d*) extending along the long edges of said cartridge clip (8) with the insertion bevels tapering inwardly toward one another in the direction towards the first end of the cartridge clip.

3. An explosive powder charge operated setting tool, as set forth in claim 2, wherein said insertion bevels extend symmetrically to one another along the long edges of said cartridge clip.

4. An explosive powder charge operated setting tool, as set forth in claim 3, wherein said cartridge clip has an extended length portion at the first end thereof free of said recesses (8*e*) and said insertion bevels are located on said extended length portion.

5. An explosive powder charge operated setting tool, as set forth in claim 1, wherein said blocking parts (13, 14) are flexural wall portions of said guide channel (9).

6. An explosive powder charge operated setting tool, as set forth in claim 1 or 5, wherein said blocking parts (13, 14) comprise blocking lugs (13*a*, 14*a*) and restraining cams (13*b*, 14*b*), and said blocking lugs (13*a*, 14*a*) are spaced upstream of said restraining cams (13*b*, 14*b*) in a feed direction of said cartridge clip (8) from said insertion end to said exit end of said guide channel (9).

7. An explosive powder charge operated setting tool, as set forth in claim 6, wherein said restraining cams (13*b*, 14*b*) have a circular arc-shaped surface facing into said guide channel (9).

8. An explosive powder charge operated setting tool, as set forth in claim 7, wherein when the cartridge clip (8) is inserted into said guide channel (9) and displaces said blocking parts (13, 14) laterally outwardly with said restraining cams (13*b*, 14*b*) in contact with the long edges of the cartridge clip (8), the spacing between said restraining cams (13*b*, 14*b*) is less than the spacing between said blocking lug (13*a*, 14*a*) disposed opposite one another.

* * * * *